US005438031A

United States Patent [19]

Shinohara et al.

[11] Patent Number: 5,438,031

[45] Date of Patent: Aug. 1, 1995

[54] PRINTING SHEET HAVING A DYE RECEIVING LAYER

[75] Inventors: Satoru Shinohara; Yoshinori Nakamura; Huy Sam, all of Miyagi, Japan

[73] Assignee: Sony Corporation, Tokyo, Japan

[21] Appl. No.: 230,767

[22] Filed: Apr. 21, 1994

[30] Foreign Application Priority Data

Apr. 22, 1993 [JP] Japan ..... 5-119127

[51] Int. Cl.[6] ..... B41M 5/035; B41M 5/38

[52] U.S. Cl. ..... 503/227; 428/195; 428/409; 428/423.1; 428/447; 428/480; 428/532; 428/913; 428/914

[58] Field of Search ..... 8/471; 428/195, 423.1, 428/480, 532, 913, 914, 409; 503/227

[56] References Cited

U.S. PATENT DOCUMENTS

| | | | |
|---|---|---|---|
| 4,962,080 | 10/1990 | Watanabe | 503/227 |
| 5,157,013 | 10/1992 | Sakai | 503/227 |
| 5,187,144 | 2/1993 | Shinohara et al. | 503/227 |
| 5,278,130 | 1/1994 | Arita et al. | 503/227 |
| 5,284,815 | 2/1994 | Uytterhoeven et al. | 503/227 |

*Primary Examiner*—B. Hamilton Hess

*Attorney, Agent, or Firm*—Hill, Steadman & Simpson

[57] ABSTRACT

A printing sheet which is adapted for use in thermal transfer recording comprises a substrate and a dye image-receiving layer formed on the substrate. The layer is made of a resin composition comprising a thermoplastic resin, an alcohol-modified silicone and an isocyanate compound. The thermoplastic resin is preferably a cellulose ester or a polyester and the isocyanate compound is preferably a mixture of aromatic and aliphatic isocyanates at an equivalent ratio of 0.1:1 to 5:1. The printing sheet has an improved sebum resistance without lowering writing properties while ensuring good fundamental characteristics such as sensitivity and image stability.

4 Claims, 1 Drawing Sheet

PRINTING SHEET HAVING A DYE RECEIVING LAYER

BACKGROUND OF THE INVENTION

1. Field of the Invention

This invention relates to a printing sheet which is adapted for forming dye images thereon by heating an ink ribbon according to image information by use of a thermal head or a laser beam to melt or diffuse the dye in an imagewise pattern and receiving the dye image on the printing sheet.

2. Description of the Prior Art

As is known in the art, there have been widely used thermal transfer recording methods wherein an ink ribbon is heated according to image information by use of a thermal head or a laser beam to thermally melt or diffuse the ink from the ink ribbon and the thus melted or diffused dye is transferred on a printing sheet. In recent years, attention has been paid to so-called sublimation-type thermal transfer recording methods wherein full color images with a continuous tone or gradation are formed using thermally diffusable dyes such as sublimable dyes. For instance, attempts have been made to form images on a video printing sheet by spottedly heating an ink ribbon according to signals of video images.

More particularly, as shown in FIG. 1, there is used a video printing sheet 1 which includes a sheet substrate 2 such as of polypropylene and a dye image-receiving layer 3 formed on the substrate 2. The dye image-receiving layer 3 is able to receive a dye transferred from an ink ribbon by heating and keeps the resultant image thereon. The image-receiving layer 3 has been conventionally made of resins which are susceptible to dyeing with dyes. Such resins include thermoplastic resins such as polyesters, polycarbonates, polyvinyl chloride, vinyl chloride copolymers such as vinyl chloride-vinyl acetate copolymers, polyurethanes, polystyrene, AS resins, ABS resins and the like.

Recently, in order to enhance sensitivity enough to form clear images and to improve the weatherability, light fastness and thermal stability of images so that once formed images can be stably kept, various attempts have been made on resins for the dye image-receiving layer. For instance, in order to improve the light fastness and weatherability of images, there has been proposed a dye image-receiving layer which is made mainly of cellulose esters.

However, as the thermal transfer recording methods have been widespread, there is an increasing demand for solving the following problem in practical applications, not to mention the improvements in the weatherability, light fastness and thermal stability. More particularly, the image formed on known printing sheets is not resistant to sebum. When the image surface is rubbed with the hand, the dye may be attached to the hand in some case. Thus, a problem to solve is to the improvement of the printing sheet in sebum resistance. Moreover, there is some demand where letters or characters are written directly on the printing sheet by use of oil base ink pens. The ink of the pen is repelled with the known printing sheets, thus not satisfying the demand. Thus, another problem involved in known printing sheets is how to improve the writing properties of printing sheet so as to permit direct writing on the sheet by means of oil base ink pens.

The reason why the dye is attached to the hand on rubbing of the image surface therewith is considered as follows: there occur at the same time extraction of the dye with the sebaceous matter from the hand and mechanical separation of the dye from the dye image-receiving layer on rubbing of the image surface with the hand or finger. In order to improve the sebum resistance to an extent that no dye is attached to the hand on rubbing of the image surface, it is desirable to use resins for the dye image-receiving layer which have high oil repellence, the capability of securely fixing dyes on the layer and good film-forming properties.

On the other hand, in order to improve writing properties by which direct writing on printing sheet with oil base ink pens is possible, it is necessary that dyes or inks dispersing dyes therein be well infiltrated into the dye image-receiving layer. The resins for such image-receiving layer are contrary to the case of improving the sebum resistance and should be oleophilic in nature, not oil-repellent.

As will be apparent from the above, resins for the image-receiving layer should have both properties required to improve the sebum resistance and properties required to improve writing properties, which are contrary to each other in nature. To improve both properties is difficult. For instance, the improvement of the sebum resistance by crosslinkage of resins through isocyanates results in a sacrifice of writing properties.

SUMMARY OF THE INVENTION

It is accordingly an object of the invention to provide a printing sheet which can solve the problems involved in the prior art.

It is another object of the invention to provide a printing sheet wherein while fundamental characteristics such as sensitivity and image stability are satisfied, the sebum resistance of a dye image-receiving layer is improved without lowering of writing properties.

We have made extensive studies on cured resins for use as a dye image-receiving layer of a printing sheet for thermal transfer recording and found that a three-dimensional structure formed from alcohol-modified silicones and isocyanates is effective for achieving the above objects.

According to the present invention, there is provided a printing sheet which comprises a sheet substrate and a dye image-receiving layer formed on the substrate, the layer being made of a resin composition which comprises a thermoplastic resin, an alcohol-modified silicone and an isocyanate compound. Usually, the resin composition is thermally cured, in which a three-dimensional structure is formed from the silicone and the isocyanate compound throughout the cured product.

DETAILED DESCRIPTION OF THE INVENTION

Figure 1:
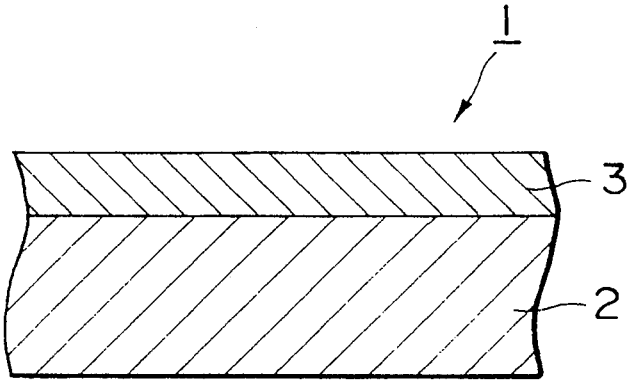
FIG. 1 is a schematic sectional view of a known printing sheet.

The printing sheet of the invention is characterized by a dye image-receiving layer which is formed from a thermoplastic resin, an alcohol-modified silicone and an isocyanate compound. The thermoplastic resins may be various types of thermoplastic resins including thermoplastic resins ordinarily used for known dye image-receiving layer. For instance, the thermoplastic resins include polyesters, polycarbonates, polyvinyl chloride, vinyl chloride copolymers such as vinyl chloride-vinyl acetate copolymers, polyvinyl acetal, polyvinylbutyral, polyamides, polyvinyl acetate, polyurethanes, polystyrene, AS resins, ABS resins, cellulose esters, polyvinyl alcohol and the like. These may be used singly or in combination. In view of sensitivity, image stability, writing properties and sebum resistance, polyesters and cellulose esters are preferred.

The isocyanate compounds may be those used as starting materials for polyurethanes. Examples include aromatic isocyanates such as 2,4-tolylenediisocyanate (2,4-TDI), 2,6-TDI, diphenylmethane-4,4'-diisocyanate (MDI), hydrogenated MDI, 1,5-naphthalenediisocyanate, triphenylmethanetriisocyanate, xylylenediisocyanate (XDI), hydrogenated XDI, meta-xylylenediisocyanate (MXDI), 3,3'-dimethyl-4,4-diphenylenediisocyanate (TODI) and the like, and aliphatic isocyanates such as isophoronediisocyanate (IPDI), trimethylhexamethylenediisocyanate (TMDI), hexamethylenediisocyanate (HDI), lysineisocyanate methyl ester (LDI), dimethyldiisocyanate (DDI) and the like.

Of these isocyanate compounds, aromatic isocyanates, particularly TDI isocyanates, are particularly effective in improving the sebum resistance because the resultant three-dimensional structure in which the isocyanates are taken is formed as rigid. Likewise, the aliphatic isocyanates, particularly, HDI isocyanates, have an effective function for sensitivity adjustment ($\gamma$ adjustment). Accordingly, it is preferred to use combinations of aromatic isocyanates and aliphatic isocyanates.

In the case, it is more preferred to use aromatic isocyanates, e.g. TDI isocyanates, and aliphatic isocyanates, e.g. HDI isocyanates, in such a way that an equivalent ratio therebetween is in the range of 0.1:1 to 5.1. If the ratio of aromatic isocyanates is too large, a very rigid three-dimensional structure is formed, into which dyes are unlikely to enter. thus lowering the sensitivity. In addition, the pot life of the composition for forming the dye image-receiving layer is shortened. On the other hand, if the content of aliphatic isocyanates is too large, the sebum resistance is not improved significantly.

The total amount of the isocyanate compounds should preferably in the range of 1 to 15 parts by weight per 100 parts by weight of the thermoplastic resin. If the content of the isocyanate compounds is too small, the sebum resistance is not improved. On the contrary, when the content is too large, a rigid three-dimensional structure is formed, with a lowering of sensitivity.

The alcohol-modified silicones should preferably be those silicones having an OH group at terminal ends thereof in order to improve the sebum resistance although not limited to the silicones set out above. In fact, various types of commercially available alcohol-modified silicones may be used. For instance, there may be used silicones available from Shin-Etsu Chemical C., Ltd. under the designations of X-22-170B (with OH group at one end), and X-22-160AS, X-22-160A, X-22-160B and X-22-160 C (all with OH at both ends), silicones available from Toshiba Silicone Co., Ltd. under the designations of XF42-220 and XF42-811 (with OH group at side chains), and XF42-831 (OH group at both ends), silicones available from Toray-Dow Corning Silicone Co., Ltd. under the designations of SF8427 (with OH group at both ends) and SF8428 (with 0H group at side chains).

The alcohol-modified silicones should preferably have an OH equivalent of 5 to 100, more preferably 5 to 70. If the OH equivalent is less than 5, the sebum resistance is not improved significantly. When the OH equivalent exceeds 100, the pot life is shortened.

The alcohol-modified silicone is used in an amount of 0.5 to 10 parts by weight per 100 parts by weight of the thermoplastic resin. If the amount is too small, the resultant layer is liable to fusion bond to an ink ribbon at the time of thermal transfer. If the amount is too large, writing properties and thermal stability lower.

The dye image-receiving layer of the printing sheet of the invention is constituted of such thermoplastic resins, alcohol-modified silicones and isocyanates as set out hereinbefore. If necessary, various additives which are miscible with these essential ingredients may be added. For instance, additives or sensitizers usable in the invention are of the type which is capable of forming an amorphous phase after miscibility with thermoplastic resins to facilitate dye diffusion or reception thereby permitting the dye to be infiltrated into the inside of the receiving layer. As a consequence, the light fastness and heat resistance of the layer are improved. Such additives include various types of esters, ethers and hydrocarbon compounds.

The esters, ethers and hydrocarbon compounds are in the form of liquid or solids having a melting point of approximately −50° to 150° C. For instance, the esters include, for example, phthalic esters such as dimethyl phthalate, diethyl phthalate, dioctyl phthalate, dicyclohexyl phthalate, diphenyl phthalate and the like, isophthalic esters such as dicyclohexyl isophthalate, aliphatic dibasic esters such as dioctyl adipate, dioctyl sebacate, dicyclohexyl azalate and the like, phosphoric esters such as triphenyl phosphate, tricyclohexyl phosphate, triethyl phosphate and the like, higher fatty acid esters such as dimethyl isophthalate, diethyl isophthalate, butyl stearate, cyclohexyl laurate and the like, silicic esters and boric esters. The ethers include, for example, diphenyl ether, dicyclohexyl ether, methyl p-ethoxybenzoate and the like. The hydrocarbon compounds include, for example, camphor, low molecular weight polyethylene, phenols such as p-phenylphenol, o-phenylphenol and the like, N-ethyltoluenesulfonic acid amide, and the like.

Fluorescent brighteners and white pigments may be further added to the dye image-receiving layer. By this, the whiteness of the layer is improved to enhance the clarity of images and the layer is imparted with good writing properties. In addition, once formed images are prevented from re-transferring. Such fluorescent brighteners and white pigments may be commercially available ones. For instance, Ubitex OB available from Ciba-Geigy GF can be used as a fluorescent brightener.

Moreover, antistatic agents may be further added to the layer in order to prevent static electricity from being generated during running through printer. Examples of the agent include cationic surface active agents such as quaternary ammonium salts, polyamide derivatives and the like, anionic surface active agents such as alkylbenzene sulfonates, sodium alkylsulfates and the like, amphoteric surface active agents, and non-ionic surface active agents. These antistatic agents may be incorporated in the image-receiving layer or may be coated on the surface of the layer.

Besides, plasticizers, UV absorbers and antioxidants may be appropriately formulated in the composition for the layer.

The thermoplastic resins, alcohol-modified silicones and isocyanates along with various additives are mixed by a usual manner and applied onto a substrate to form a dye image-receiving layer. Usually, the applied layer is cured by heating at a temperature ranging from 80° to 140° C. for several minutes. If necessary, post curing at lower temperatures, e.g. at 50° C., is effectively used.

The printing sheet of the invention is characterized by the dye image-receiving layer arranged as set out hereinbefore. The printing sheet of the invention other than the receiving layer may be arranged in the same manner as in prior art. For instance, the substrate may be paper sheets such as wood-free paper, coated paper and the like, various types of plastic sheets, and laminated sheets thereof, like known printing sheets. If necessary, the substrate may have a lubricating layer on a side opposite to the side on which the receiving layer is formed. Images may be formed on the printing sheet of the invention according to any known procedures. For instance, dyes to be transferred are not critical with respect to the kind.

Since the printing sheet of the invention has a dye image-receiving layer which is formed of thermoplastic resins, alcohol-modified silicones and isocyanates, the layer has a three-dimensional structure which has an appropriate degree of hardness. Accordingly, the writing properties and sebum resistance are improved without lowering of the sensitivity and image stability required for printing sheet.

The invention is more particularly described by way of examples.

Examples 1 to 30 and Comparative Examples 1 to 5

Compositions for dye image-receiving layer were prepared with formulations shown in Tables 1 to 3. Each composition was applied onto a 150 μm thick synthetic paper (commercial name of FPG-150) in a dry thickness of 10 μm, followed by curing at 120° C. for 2 minutes. In this manner, printing sheets of the examples and comparative examples were made.

Evaluation

The respective printing sheets were subjected to tone printing using a thermal transfer printer using an ink ribbon (VPM-30 of Sony Corporation) comprised of yellow (Y), magenta (M) and cyan (C) dyes. The resultant images were evaluated in the following manner with respect to writing properties and sebum resistance. The results are summarized in Tables 4 and 5.

Moreover, the respective compositions prepared for making printing sheets were evaluated with respect to pot life in the following manner.

(i) Writing properties

An oil base ink pen (Tombow F-1 of Tombow Pencil Co., Ltd.) was used to write on individual test sheets. Five seconds after the writing, the written portion of the sheet was rubbed with a finger, followed by visual observation. The results of the observation were assessed by five ranks. More particularly, when the initial written state was well held without involving any ink trail, such a sheet was assessed as 5. On the other hand, when the oil base ink was repelled with not writing being possible, the sheet was assessed as 1.

(ii) Sebum resistance

Artificial sebum was applied on the printed surface, followed by rubbing five times and the degree of color removal was visually observed. The printed surface was evaluated by five ranks wherein the surface state which was held good without any color removal was assessed as 5 and a substantial degree of the color removal was evaluated as 1.

(iii) Pot life

Each composition was allowed to stand at room temperature for 8 hours after its preparation and the transparency of the composition was visually observed. The results of the observation were evaluated by five ranks wherein when the composition was transparent and underwent no change therein, it was evaluated as 5 and a clouded composition was evaluated as 1.

TABLE 1

(unit: parts by weight)

| Composition for dye image-receiving layer | Example 1 | 2 | 3 | 4 | 5 | 6 | 7 | 8 | 9 |
|---|---|---|---|---|---|---|---|---|---|
| Thermoplastic resin | | | | | | | | | |
| cellulose acetate butyrate: CAB551-0.01 of Kodak | 100 | | | | | 100 | 100 | 100 | 100 |
| polyester: Vylon 200 of Toyobo | | 100 | | | | | | | |
| Polyester: Vylon 600 of Toyobo | | | | | | | | | |
| AS resin: Stylax-AS 769 of Asahi Chem. Co., Ltd. | | | 100 | | | | | | |
| Vinyl chloride-vinyl acetate copolymer: #1000GK of Denki Chemical Co., Ltd. | | | | 100 | | | | | |
| Polyvinylbutyral: BX-1 of Sekisui Chem. Co., Ltd. | | | | | 100 | | | | |
| Vinyl acetate polymer: C5 of Sekisui Chemical Co., Ltd. | | | | | | | | | |
| OH-modified silicone | | | | | | | | | |
| OH-modified silicone (OH equivalent = 4) | | | | | | | | | |
| OH-modified silicone (OH equivalent = 5) | | | | | | | | | |
| OH-modified silicone (OH equivalent = 9) | | | | | | | | | |
| OH-modified silicone (OH equivalent = 20) | | | | | | | | | |
| OH-modified silicone (OH equivalent = 35) | 3 | 3 | 3 | 3 | 3 | 3 | 3 | 3 | 3 |
| OH-modified silicone (OH equivalent = 62) | | | | | | | | | |
| OH-modified silicone (OH equivalent = 99) | | | | | | | | | |
| OH-modified silicone (OH equivalent = 112) | | | | | | | | | |
| Isocyanate compound | | | | | | | | | |
| TDI-base isocyanate (NCO equivalent of 320) | 2 | 2 | 2 | 2 | 2 | | | | |
| TDI-base isocyanate (NCO equivalent of 370) | | | | | | | | 4 | |
| HDI-base isocyanate (NCO equivalent of 320) | 2 | 2 | 2 | 2 | 2 | | | | 4 |
| IPDI-base isocyanate (NCO equivalent of 360) | | | | | | 4 | | | |
| TDI-base isocyanate (NCO equivalent of 320) | | | | | | | 4 | | |
| Others | | | | | | | | | |
| Sensitizer (DBP of Kasei Vinyl Co., Ltd.) | | | | | | | | | |
| Sensitizer (DCHP of Osaka Organic Chemical Co., Ltd.) | | | | | | | | | |
| MEK | 200 | 200 | 200 | 200 | 200 | 200 | 200 | 200 | 200 |

TABLE 1-continued

| Toluene | 200 | 200 | 200 | 200 | 200 | 200 | 200 | 200 | 200 |
|---|---|---|---|---|---|---|---|---|---|

| Composition for dye image-receiving layer | Example 10 | 11 | 12 | 13 | 14 | 15 |
|---|---|---|---|---|---|---|
| Thermoplastic resin | | | | | | |
| cellulose acetate butyrate: CAB551-0.01 of Kodak | 100 | 100 | 100 | 100 | 100 | 100 |
| polyester: Vylon 200 of Toyobo | | | | | | |
| Polyester: Vylon 600 of Toyobo | | | | | | |
| AS resin: Stylax-AS 769 of Asahi Chem. Co., Ltd. | | | | | | |
| Vinyl chloride-vinyl acetate copolymer: #1000GK of Denki Chemical Co., Ltd. | | | | | | |
| Polyvinylbutyral: BX-1 of Sekisui Chem. Co., Ltd. | | | | | | |
| Vinyl acetate polymer: C5 of Sekisui Chemical Co., Ltd. | | | | | | |
| OH-modified silicone | | | | | | |
| OH-modified silicone (OH equivalent = 4) | | | | | | |
| OH-modified silicone (OH equivalent = 5) | | | | | | |
| OH-modified silicone (OH equivalent = 9) | | | | | | |
| OH-modified silicone (OH equivalent = 20) | | | | | | |
| OH-modified silicone (OH equivalent = 35) | 3 | 3 | 3 | 3 | 3 | 3 |
| OH-modified silicone (OH equivalent = 62) | | | | | | |
| OH-modified silicone (OH equivalent = 99) | | | | | | |
| OH-modified silicone (OH equivalent = 112) | | | | | | |
| Isocyanate compound | | | | | | |
| TDI-base isocyanate (NCO equivalent of 320) | 3.67 | 3.64 | 3.5 | 3 | 0.36 | 0.33 |
| TDI-base isocyanate (NCO equivalent of 370) | | | | | | |
| HDI-base isocyanate (NCO equivalent of 320) | 0.33 | 0.36 | 0.5 | 1 | 3.64 | 3.67 |
| IPDI-base isocyanate (NCO equivalent of 360) | | | | | | |
| TDI-base isocyanate (NCO equivalent of 320) | | | | | | |
| Others | | | | | | |
| Sensitizer (DBP of Kasei Vinyl Co., Ltd.) | | | | | | |
| Sensitizer (DCHP of Osaka Organic Chemical Co., Ltd.) | | | | | | |
| MEK | 200 | 200 | 200 | 200 | 200 | 200 |
| Toluene | 200 | 200 | 200 | 200 | 200 | 200 |

TABLE 2

(unit: parts by weight)

| Composition for dye image-receiving layer | Example 16 | 17 | 18 | 19 | 20 | 21 | 22 | 23 | 24 |
|---|---|---|---|---|---|---|---|---|---|
| Thermoplastic resin | | | | | | | | | |
| cellulose acetate butyrate: CAB551-0.01 of Kodak | 100 | 100 | 100 | 100 | 100 | 100 | 100 | 100 | 100 |
| polyester: Vylon 200 of Toyobo | | | | | | | | | |
| Polyester: Vylon 600 of Toyobo | | | | | | | | | |
| AS rsin: Stylax-AS 769 of Asahi Chem. Co., Ltd. | | | | | | | | | |
| Vinyl chloride-vinyl acetate copolymer: #1000GK of Denki Chemical Co., Ltd. | | | | | | | | | |
| Polyvinylbutyral: BX-1 of Sekisui Chem. Co., Ltd. | | | | | | | | | |
| Vinyl acetate polymer: C5 of Sekisui Chemical Co., Ltd. | | | | | | | | | |
| OH-modified silicone | | | | | | | | | |
| OH-modified silicone (OH equivalent = 4) | | | | | 3 | | | | |
| OH-modified silicone (OH equivalent = 5) | | | | | | 3 | | | |
| OH-modified silicone (OH equivalent = 9) | | | | | | | 3 | | |
| OH-modified silicone (OH equivalent = 20) | | | | | | | | 3 | |
| OH-modified silicone (OH equivalent = 35) | 3 | 3 | 3 | 3 | | | | | |
| OH-modified silicone (OH equivalent = 62) | | | | | | | | | 3 |
| OH-modified silicone (OH equivalent = 99) | | | | | | | | | |
| OH-modified silicone (OH equivalent = 112) | | | | | | | | | |
| Isocyanate compound | | | | | | | | | |
| TDI-base isocyanate (NCO equivalent of 320) | 2 | | | 2 | 2 | 2 | 2 | 2 | 2 |
| TDI-base isocyanate (NCO equivalent of 370) | | | | | | | | | |
| HDI-base isocyanate (NCO equivalent of 320) | 2 | | 2 | | 2 | 2 | 2 | 2 | 2 |
| IPDI-base isocyanate (NCO equivalent of 360) | | 2 | 2 | | | | | | |
| TDI-base isocyanate (NCO equivalent of 320) | | 2 | | 2 | | | | | |
| Others | | | | | | | | | |
| Sensitizer (DBP of Kasei Vinyl Co., Ltd.) | | | | | | | | | |
| Sensitizer (DCHP of Organic Chemical Co., Ltd.) | | | | | | | | | |
| MEK | 200 | 200 | 200 | 200 | 200 | 200 | 200 | 200 | 200 |
| Toluene | 200 | 200 | 200 | 200 | 200 | 200 | 200 | 200 | 200 |

| Composition for dye image-receiving layer | Example 25 | 26 | 27 | 28 | 29 | 30 |
|---|---|---|---|---|---|---|
| Thermoplastic resin | | | | | | |
| cellulose acetate butyrate: CAB551-0.01 of Kodak | 100 | 100 | 80 | | 100 | |
| polyester: Vylon 200 of Toyobo | | | | | | 100 |
| Polyester: Vylon 600 of Toyobo | | | | 30 | | |
| AS rsin: Stylax-AS 769 of Asahi Chem. Co., Ltd. | | | | | | |
| Vinyl chloride-vinyl acetate copolymer: | | | | 70 | | |

TABLE 2-continued

| | | | | | | |
|---|---|---|---|---|---|---|
| #1000GK of Denki Chemical Co., Ltd. | | | | | | |
| Polyvinylbutyral: BX-1 of Sekisui Chem. Co., Ltd. | | | | | | |
| Vinyl acetate polymer: C5 of Sekisui Chemical Co., Ltd. | | | 20 | | | |
| OH-modified silicone | | | | | | |
| OH-modified silicone (OH equivalent = 4) | | | | | | |
| OH-modified silicone (OH equivalent = 5) | | | | | | |
| OH-modified silicone (OH equivalent = 9) | | | | | | |
| OH-modified silicone (OH equivalent = 20) | | | | | | |
| OH-modified silicone (OH equivalent = 35) | | | 3 | 3 | 3 | 3 |
| OH-modified silicone (OH equivalent = 62) | | | | | | |
| OH-modified silicone (OH equivalent = 99) | 3 | | | | | |
| OH-modified silicone (OH equivalent = 112) | | 3 | | | | |
| Isocyanate compound | | | | | | |
| TDI-base isocyanate (NCO equivalent of 320) | 2 | 2 | 2 | 2 | 2 | 2 |
| TDI-base isocyanate (NCO equivalent of 370) | | | | | | |
| HDI-base isocyanate (NCO equivalent of 320) | 2 | 2 | 2 | 2 | 2 | 2 |
| IPDI-base isocyanate (NCO equivalent of 360) | | | | | | |
| TDI-base isocyanate (NCO equivalent of 320) | | | | | | |
| Others | | | | | | |
| Sensitizer (DBP of Kasei Vinyl Co., Ltd.) | | | | | 15 | |
| Sensitizer (DCHP of Organic Chemical Co., Ltd.) | | | | | | 10 |
| MEK | 200 | 200 | 200 | 200 | 200 | 200 |
| Toluene | 200 | 200 | 200 | 200 | 200 | 200 |

TABLE 3

(unit: parts by weight)

| Composition for Dye Image-Receiving Layer | Comparative Example 1 | 2 | 3 | 4 | 5 |
|---|---|---|---|---|---|
| cellulose acetate butyrate: CAB551-0.01 of Kodak | 100 | 100 | | | |
| polyester: Vylon 200 of Toyobo | | | 100 | | |
| polyvinylbutyral: BX-1 of Sekisui Chem. Co., Ltd. | | | | 100 | |
| vinyl chloride-vinyl acetate polymer: #1000 GK of Denki Chem. Co., Ltd. | | | | | 100 |
| OH-modified silicone (OH equivalent = 35) | 3 | | 3 | | |
| TDI-base isocyanate (NCO equivalent = 320) | | 2 | | 2 | 2 |
| HDI-base isocyanate (NCO equivalent = 320) | | 2 | | 2 | 2 |
| MEK | 200 | 200 | 200 | 200 | 200 |
| toluene | 200 | 200 | 200 | 200 | 200 |

As will be apparent from the results of the tables, the printing sheets of the examples are improved in the sebum resistance without lowering the writing property on comparison with those sheets of the comparative examples. In addition, the compositions of the invention exhibit good pot life and the printing sheets can be produced without any trouble.

Thus, it will be seen that the printing sheet of the invention is improved in the sebum resistance without lowering the writing properties while ensuring good fundamental characteristics such as sensitivity and image stability.

What is claimed is:

1. A printing sheet including a substrate having a dye image-receiving layer thereon, the dye image-receiving layer consisting essentially of:

(a) 100 parts by weight of a thermoplastic resin selected from the group consisting of polyesters and cellulose esters;

(b) from about 1 to about 15 parts by weight per 100 parts by weight of component (a) of an isocyanate component comprising an aromatic isocyanate and an aliphatic isocyanate present an in equivalent ratio of from about 0.1:1 to about 5.1, respectively; and,

TABLE 4

| | Example 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| writing property | 5 | 5 | 4 | 4 | 4 | 5 | 5 | 4 | 5 | 4 | 5 | 5 | 5 | 5 | 5 |
| sebum resistance | 5 | 5 | 5 | 5 | 5 | 4 | 4 | 5 | 4 | 5 | 5 | 5 | 5 | 5 | 4 |
| pot life | 5 | 5 | 5 | 4 | 4 | 4 | 4 | 4 | 5 | 4 | 5 | 5 | 5 | 5 | 5 |

| | Example 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|
| writing property | 5 | 5 | 5 | 5 | 5 | 5 | 5 | 5 | 5 | 5 | 5 | 5 | 5 | 5 | 5 |
| sebum resistance | 4 | 4 | 4 | 4 | 4 | 5 | 5 | 5 | 5 | 5 | 4 | 5 | 5 | 5 | 5 |
| pot life | 4 | 4 | 5 | 4 | 4 | 5 | 5 | 5 | 5 | 5 | 4 | 5 | 5 | 5 | 5 |

TABLE 5

| | Comparative Example 1 | 2 | 3 | 4 | 5 |
|---|---|---|---|---|---|
| writing property | 4 | 5 | 5 | 4 | 4 |
| sebum resistance | 1 | 1 | 2 | 2 | 2 |
| pot life | 5 | 5 | 5 | 4 | 4 |

(c) from about 0.5 to about 10 parts by weight per 100 parts by weight of component (a) of a hydroxyl-terminated silicone, the hydroxyl-terminated silicone having an OH equivalent of from about 5 to about 100, said printing sheet exhibiting good sebum resistance, such that artificial sebum may be applied onto a surface of the dye-receiving layer which has been printed on with a colored ink ribbon and rubbed five times substantially without any color removal, and the said printing sheet exhibiting good writing properties, such that an oil based ink pen may be used to write on the image-receiving layer and after about 5 seconds, the writing may be rubbed with a finger substantially without any ink trail being formed.

2. A printing sheet according to claim 1, wherein said thermoplastic resin is a polyester.

3. A printing sheet according to claim 1, wherein said thermoplastic resin is a cellulose ester.

4. A printing sheeting according to claim 1, wherein said dye receiving layer has a cured 3-dimensional structure having a thickness of about 10 $\mu$m.

* * * * *